US009421603B2

(12) United States Patent
Toth et al.

(10) Patent No.: US 9,421,603 B2
(45) Date of Patent: Aug. 23, 2016

(54) FORGING PRESS

(71) Applicant: SMS Meer GmbH, Mönchengladbach (DE)

(72) Inventors: Walter Toth, Neuss (DE); Johannes Rolf, Hennef (DE); Heinz Kannen, Grevenbroich (DE); Peter Stenger, Moenchengladbach (DE)

(73) Assignee: SMS MEER GMBH, Moenchengladbach (DE)

( * ) Notice: Subject to any disclaimer, the term of this patent is extended or adjusted under 35 U.S.C. 154(b) by 0 days.

(21) Appl. No.: 14/708,371

(22) Filed: May 11, 2015

(65) Prior Publication Data

US 2015/0321244 A1 Nov. 12, 2015

(30) Foreign Application Priority Data

May 9, 2014 (DE) ..... 10 2014 208 776

(51) Int. Cl.
*B21J 9/12* (2006.01)
*B21J 5/02* (2006.01)
*B21J 9/02* (2006.01)

(52) U.S. Cl.
CPC .... *B21J 9/12* (2013.01); *B21J 5/02* (2013.01); *B21J 5/025* (2013.01); *B21J 9/022* (2013.01)

(58) Field of Classification Search
CPC ..... B21D 24/02; B21J 9/02; B21J 7/34; B21J 9/12; B21J 5/02; B21J 9/022; B21K 1/76; B21K 21/10
USPC ..... 72/453.06
See application file for complete search history.

(56) References Cited

U.S. PATENT DOCUMENTS 3,381,515 A * 5/1968 Orloff ..... B21K 1/76 72/354.2
3,898,834 A * 8/1975 Kramer ..... B21J 7/34 72/453.13
4,776,197 A * 10/1988 Scott ..... B21K 21/10 72/355.6
5,425,170 A * 6/1995 Spiegelberg ..... H01M 2/305 29/730
5,511,406 A * 4/1996 Panasiuk ..... B21D 24/02 72/446
6,626,022 B1 * 9/2003 Stamm ..... B21J 9/02 72/417
6,626,023 B1 * 9/2003 Kodani ..... B21D 24/02 100/269.14

* cited by examiner

*Primary Examiner* — David B Jones
(74) *Attorney, Agent, or Firm* — Andrew Wilford

(57) ABSTRACT

A forging press for rotationally asymmetrical parts by warm or hot forming has a stationary press table, a vertically shiftable press ram above the press table, vertically delimiting with the press table a working space, and vertically displaceable between from an upper open position into a lower closed position. An upper part is carried by the ram in the space, and an upper die in the space is in turn carried on the upper part. A lower part sits on the table in the space and below the upper part and carries a lower die in the space and fittable with the upper die in the closed position. A first closing apparatus outside the space bears vertically on one of the dies, and a second closing apparatus outside the space bears vertically via the first closing apparatus on the one die.

7 Claims, 3 Drawing Sheets

FORGING PRESS

FIELD OF THE INVENTION

The present invention relates to a forging press. More particularly this invention concerns a forging press.

BACKGROUND OF THE INVENTION

An apparatus for forging parts, particularly forged rotationally asymmetrical parts by warm or hot forging, comprising at least one upper part, at least one upper die half as well as at least one lower die half and at least one lower tool, at least a first closing apparatus and at least a second closing apparatus, wherein the upper part and the lower tool are provided in a working space delimited by a press ram and a press table and can be moved relative to one another between a starting position and a closed position.

The invention furthermore relates to a press for forging parts, particularly forged rotationally asymmetrical parts by warm forming or hot forming. Presses of this type are usually used as multi-stage presses in a burr-free forging method.

Die-forging presses for burr-free forging, particularly of rotationally asymmetrical parts, are used more and more frequently, above all for the automotive industry, because the weight of the components can be reduced by a shape that does not have rotational symmetry. During die forging, preferably burr-free die forging of rotationally asymmetrical parts, the upper die half is normally pressed down against the lower die half, thereby closing the die. Shaping takes place using at least one further pressing punch, called the knockout punch. The knockout punch is normally rigidly fixed in place, so that for shaping, the two die halves are moved relative to the knockout punch. This takes place in that the press ram on which the upper die half is usually fixed in place presses down against the lower die half, and the two die halves are moved downward and thereby relative to the knockout punch.

Such an apparatus is known, for example, from US 2002/0040589, in which die forging takes place between an upper and a lower die respectively supported on an upper and a lower tool. A first closing apparatus and a second closing apparatus, which are provided between the tool parts or on the lower tool, allow reliable filling of the mold for the forging process. The closing force is adapted to the required pressing force progression required for complete filling of the tool, by two closing apparatuses that exert different closing forces.

However, a disadvantage of the solutions known from the state of the art is a decidedly complicated and expensive tool structure, which has a plurality of individual parts in the working space, in other words in the space that is formed vertically by the closing dimension of the press and horizontally by the outer dimensions of press table and press ram.

The required construction space of the devices known from the state of the art accordingly does not permit any automatic forged part transfer and also hinders the use of usual manipulators for spray application of cooling and/or lubricating media.

This leads to the necessity of designing new and complicated peripheral systems for operation of such forging apparatuses. Also, in the case of unforeseen malfunctions, functional parts of the apparatus can be destroyed due to the closeness of the components of the closing apparatus to the tools, and as a result the system must be shut down for an extended period of time.

A further disadvantage of that the solutions previously known from the state of the art is that they only allow the use of comparatively slight closing forces, and that a not insignificant introduction of heat from the forging process into components of the closing apparatus, particularly ring pistons, cylinders, seals or piston accumulators takes place. This results in more rapid wear of the seals, connected with undesirable leaks.

Finally, rapid tool replacement is also prevented due to the arrangements known from the state of the art.

OBJECTS OF THE INVENTION

It is therefore an object of the present invention to provide an improved forging press.

Another object is the provision of such an improved forging press that overcomes the above-given disadvantages, in particular that is able to overcome the disadvantages known from the state of the art.

SUMMARY OF THE INVENTION

A forging press for rotationally asymmetrical parts by warm or hot forming has according to the invention a stationary press table, a vertically shiftable press ram above the press table, vertically delimiting with the press table a working space, and vertically displaceable between from an upper open position into a lower closed position. An upper part is carried by the ram in the space, and an upper die in the space is in turn carried on the upper part. A lower part sits on the table in the space and below the upper part and carries a lower die in the space and fittable with the upper die in the closed position. A first closing apparatus outside the space bears vertically on one of the dies, and a second closing apparatus outside the space bears vertically via the first closing apparatus on the one die.

In this way, the forming mechanism is uncoupled, to the greatest possible extent, from the closing mechanism of the apparatus, so that the risk of collision of the closing apparatuses with manipulators or laying-in tools or the like can be prevented. In total, the available space for both the closing apparatus and for the tools is increased.

The dies that are closed for cross-flow pressing generate the required closing forces, using the closing apparatuses, outside of the working space, thereby causing a simple and robust tool structure to be obtained.

The space required for the standard devices usually used, such as, for example, transfer devices and spray manipulators, are not restricted by the invention.

In particular, separation of tool and force generation devices takes place, by way of which a factory closing movement of upper part and lower part, for example using simple cylinders or pistons for the tools.

Furthermore, the tool structure is significantly simplified, because the closing apparatuses are provided spatially separated from the tool parts.

Also, significant advantages occur with regard to the design of the closing apparatuses, because these can be configured more freely.

A preferred embodiment is especially characterized in that the working space is delimited vertically by the apparatus closing dimension, and horizontally by the outer dimensions of the press ram and/or of the press table.

The first and the second closing apparatus are furthermore preferably an integral part of the apparatus for forging parts or of a press for forging, and are configured so that they can be switched on and off independent of a tool structure and a forging method. Thereby the lower tool, in particular, can be configured to have a significantly simpler design.

The first and the second closing apparatus preferably work switched in series with one another, and therefore following one another in terms of time and space.

For this purpose, the first and second closing apparatus preferably make different closing forces available, which allow adaptation of the closing force of the forming apparatus to the required pressing force progression, for complete mold filling of the tool. Typically, the first or upper closing unit exerts a lesser force than the lower closing unit and, only when the upper unit bottoms out on the lower unit, does the lower closing unit come into action with a greater force.

Preferably, the closing apparatuses are connected with their respective compartments, in which a compressible medium is stored under pressure, in order to apply the force required for closing the tools.

The first as well as the second closing apparatus can consist of one or more cylindrical spaces that are provided spatially in such a manner that the characteristics of a multi-stage press (distance between stations) are maintained.

With this structural arrangement, up to 6000 kN can be applied at a press size of 31.5 MN and a distance between stations of 380 mm, for example.

In particular, it is preferred if the first closing apparatus allows a greater closing path then the second closing apparatus, and if the first closing apparatus applies a lesser closing force to the tools than the second closing apparatus.

It is particularly preferred, in this connection, if the second closing apparatus is effective only when the closing stroke of the first closing apparatus has been completed.

It is exceedingly preferred, in this connection, if second closing becomes effective after the first closing apparatus has run up against a mechanical stop formed by the second apparatus.

In a preferred embodiment of the invention, the first and the second closing apparatus are provided below the working space and particularly below the press table. In this way, the uncoupling of tools and closing apparatuses according to the invention can be brought about using particularly simple means. Furthermore, the first and second closing apparatus can be placed on the apparatus for forming with a very simple design.

Preferably, the first and the second closing apparatus interact with the lower tool by way of at least one pressure rod, so that a connection exists between the lower tool and the closing apparatuses.

An embodiment in which four pressure rods are connected with the lower tool is exceedingly preferred.

According to a further particularly preferred embodiment of the invention, the at least one pressure rod is structured in two or three sections, so that when removing the lower tool, the entire force transfer mechanism and the entire length of the pressure rod or pressure rods do not have to be removed.

It is particularly preferred if the division of the pressure rod or pressure rods is structured in such a manner that the lower die can be removed from the lower tool in the open starting position of the apparatus, so that displacement of lower tool relative to the upper part beyond the dimension of the starting position of the forming device is not required for tool replacement.

If the pressure rod is structured in two parts, removal of the lower tool from the table that supports it can take place. If, however, the pressure rod is structured in three parts, both removal of the lower tool and removal of the tool pot, including the lower die alone, finally also removal of only the lower die, can take place.

In total, the forming apparatus according to the invention allows a variable structure of multiple forming stages with differences with regard to the for the closing force and the displacement path of the tools relative to one another.

Because the apparatus according to the invention can be operated, as necessary, both with the first closing apparatus and/or the second closing apparatus alone or, alternatively, in essentially any desired combination of first and second closing apparatus, the possibility of setting different closing force characteristic lines as well as reducing the accelerated masses is opened up.

In particular, the embodiment of the forming apparatus according to the invention allows avoiding an impact-type stress for the force-generating element.

Finally, it should be stated that the apparatus according to the invention can be switched on and off without additional costs for the tool system as a whole, depending on demand, both for traditional burr-free forging and for cross-flow pressing in closed dies. The ongoing tool costs for cross-flow pressing in closed dies are thereby almost equal to the tool costs in traditional burr-free forging.

Furthermore, the invention allows the continued use of the standard components already used in previous presses, particularly multi-stage presses, such as, for example, transfer devices, spray-technology devices, tool holders or tool replacement systems.

According to a further aspect of the invention, a press is provided comprising at least one apparatus according to the first aspect of the invention.

It is particularly preferred if this press is a multi-stage press.

Likewise, it is preferred if the press according to the second aspect of the invention, just like the forming apparatus according to the first aspect of the invention, is suitable for performing both a burr-free forging process and a cross-flow pressing process.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
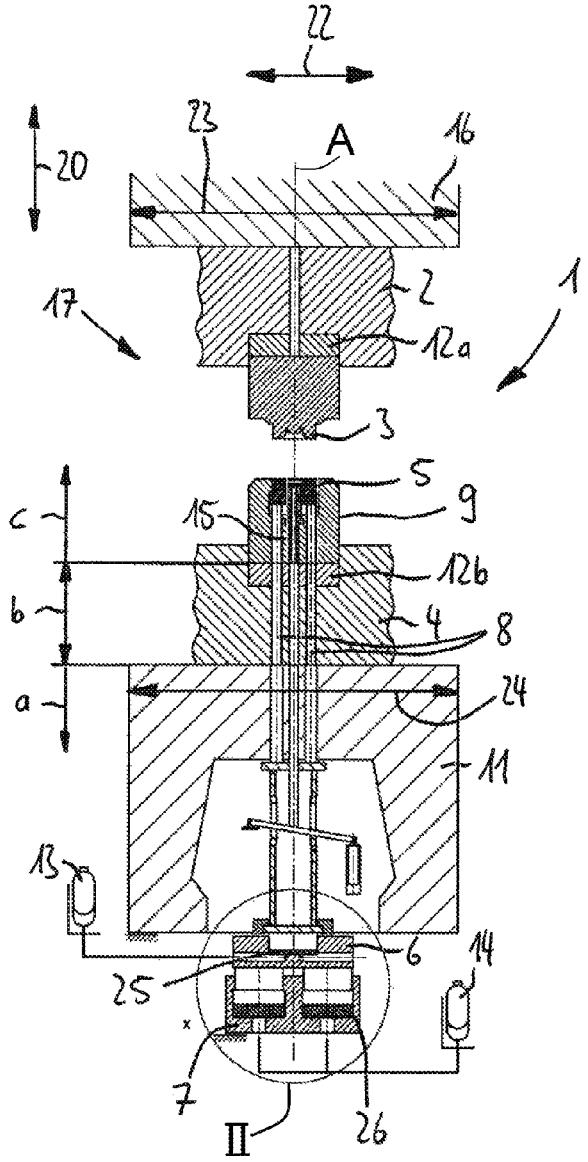
FIG. 1 is a partly schematic vertical section through an apparatus for forging parts in an open position.

As seen in FIG. 1 a forging press according to the invention has a vertically displaceable upper tool part 2 and a lower tool part 4 that respectively carry an upper die 3 on a backing plate 12*a* and a lower die 5 on a backing plate 12*b*. A tool holder 9 sits on the lower plate 12*b* and carries the lower die 5 such that it can move vertically limitedly along an axis A relative to the fixed lower tool 4. The lower tool part 4 lies on a stationary press table 11, and the upper part 2 is carried on a press ram 16 shiftable vertically in direction 20.

In this regard, the upper part 2 and the lower part 4 together form a working space 17 that is centered on the axis A and delimited at the top by the press ram 16 and at the bottom by the press table 11 and that is delimited horizontally by the horizontal dimensions 23 or 24 of the ram 16 or table 11, which both may be of circular shape centered on the press axis A.

The movement of the lower die 5 only takes place after the die for burr-free forging, composed of the upper die 3 and the lower die 5, has been closed.

FIG. 1 shows the starting position at the upper dead center for the apparatus 1, with a maximum vertical spacing between upper part 2 and lower tool 4.

Pressure rods 8 are each formed by three sections in the embodiment shown, a lower section a engaging upward against a center section b at the upper face of the table 11. Each section b engages a respective upper section c at the upper face of the plate 12*b* on which sits the tool support or pot 9.

The apparatus 1 for forming has upper and lower closing apparatuses 6 and 7 that are outside of the working space 17 delimited vertically between the press ram 16 and the press table 11, and in fact in a downwardly open axially centered cavity formed in the table 11

More precisely, the working space 17 is delimited vertically essentially by vertical space between the lower face of the ram 16 and the upper face of the table 11 and horizontally by the outer dimensions 23 of the press ram 16 or of the press table 11.

After the closing procedure of the tool, during which the upper part 2 is moved toward the lower tool 4 by the press ram 16, closing forces are brought to bear against the closing apparatuses 6 and 7. The two closing apparatuses 6 and 7 are provided below the lower tool part 4, in particular, and actually below the press table 11, so that the closing apparatuses 6, 7 can be configured very freely, in terms of design.

Figure 2:
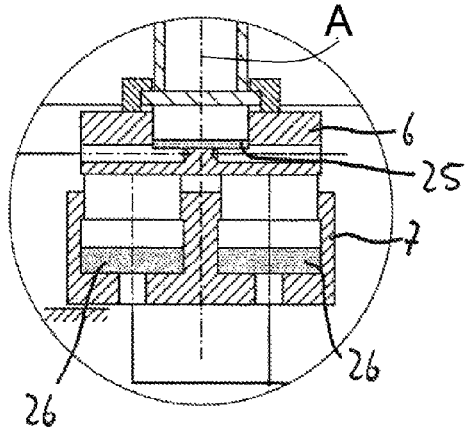
FIG. 2 is a partly schematic view of the detail indicated at II in FIG. 1.

FIG. 2 shows how the a pressurizable compartment 25 of the first closing apparatus 6 of the apparatus 1 and the pressurizable compartment 26 of the second closing apparatus 7 of the apparatus 1 are shown enlarged. Typically the pressure exerted by the lower unit 7 is greater than that of the upper unit 6, the upper unit 6 sits atop and is carried by the lower unit 7, and the pressure rods 8 bear downward (via a pair of end plates and a vertical tube) on the top of the upper unit 6

Figure 3:
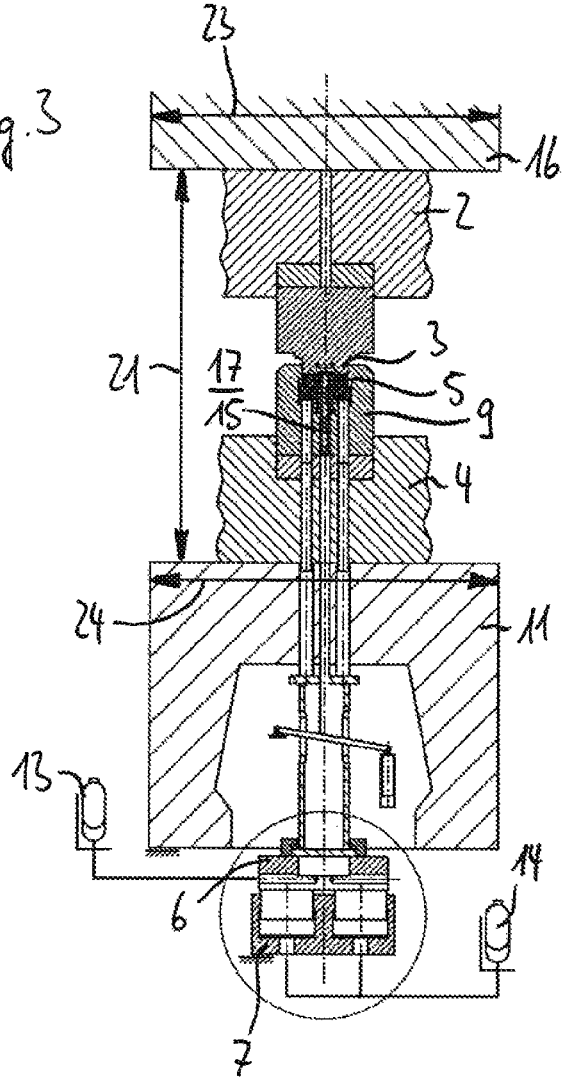
FIG. 3 is a partly schematic vertical section through an apparatus for forging parts as in FIG. 1, but in a closed position.

FIG. 3 shows the apparatus 1 from FIG. 1 in its closed position at the lower dead center in which the upper die 3 and the lower die 5 have moved toward one another and thereby form the die for burr-free forging of a part when closed.

The lower tool 4 with the lower die 5 is held up by two closing apparatuses 6 that 7 that in turn are connected with respective pressure storage units 13 and 14 and by the four pressure rods 8, between which a knockout punch 15 is provided.

The closing apparatuses 6 and 7 are structured in series, in such a manner that the small compartment 25 of the first closing apparatus 6 is provided above the larger compartment 26 of the second closing apparatus 7.

In this way, a controlled pressing force progression within the die, between the upper die 3 and the lower die 5, is achieved by a regulated and controlled counter-force of the closing apparatuses 6 and 7 against the force of the upper part 2 that which is directed downward onto the die 5.

Figure 4:
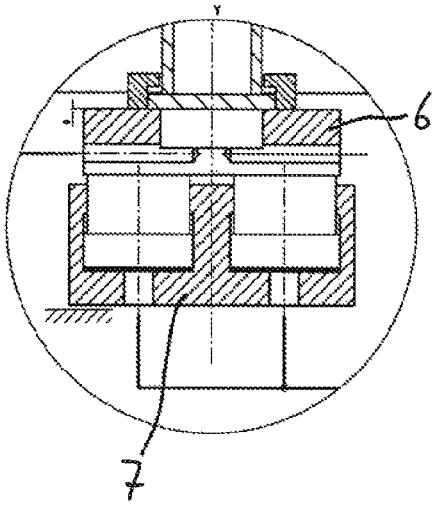
FIG. 4 is a partly schematic view of the detail indicated at IV in FIG. 1.

As can be seen in FIG. 4, the second closing apparatus 7 is effective when the closing path of the first closing apparatus 6 has been completed by running up onto a mechanical stop or bottoming out of the closing unit 6 on the closing unit 7.

Figure 5:
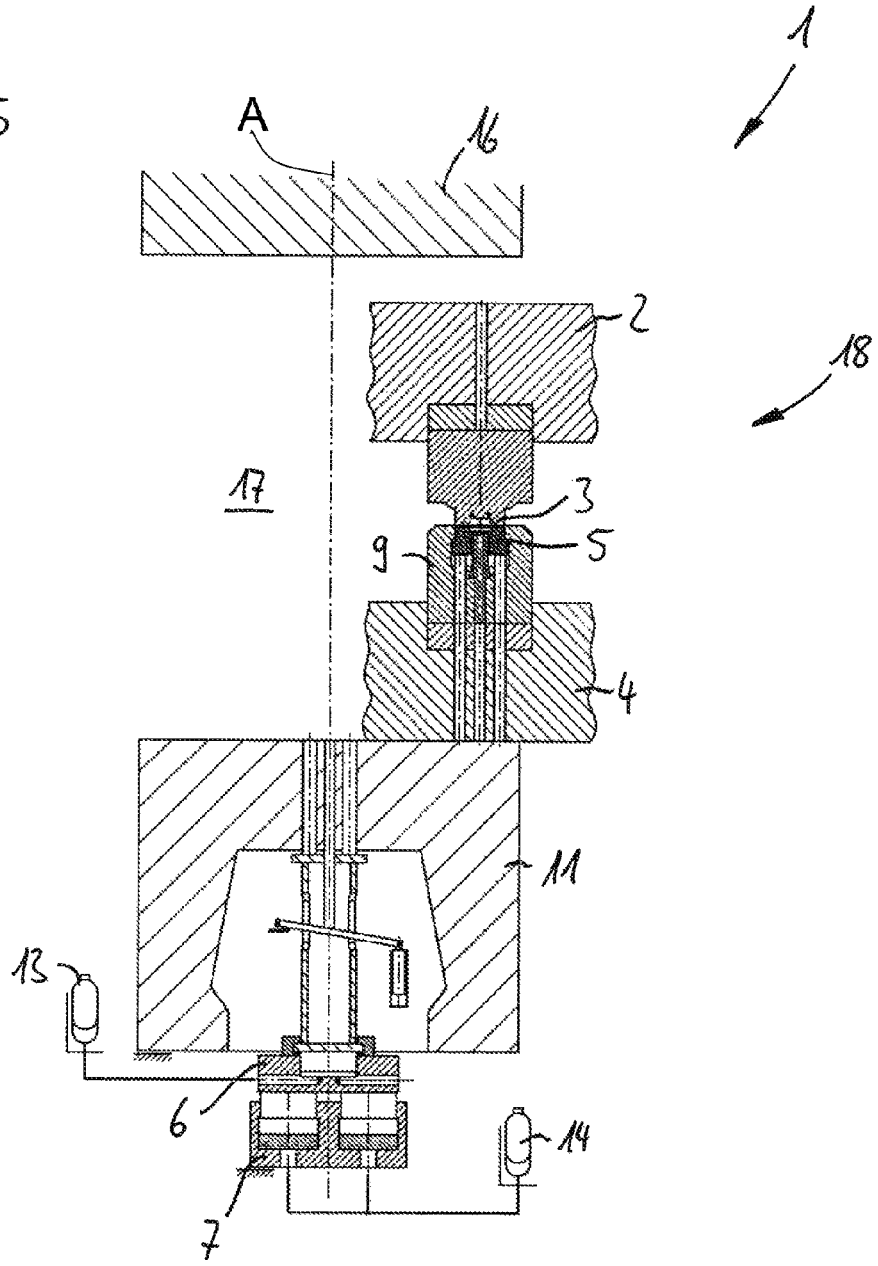
FIG. 5 is a further partly schematic section through the apparatus according to the invention during tool replacement.

FIG. 5 shows one of the possibilities of tool replacement, in which the lower tool 4 and the upper part 2, including the die halves 3 and 5, as well as any accessories, if applicable, can be jointly replaced as a subassembly 18, being removed from the working space 17 of the apparatus 1 for forming.

This is made possible, among other things, in that the placement of the two closing apparatuses takes place outside of the working space 17, here below the press table 11.

In this connection, it is furthermore advantageous that uncoupling of the lower tool 4 and the closing apparatuses 6 and 7 exists, wherein this takes place by the pressure rods 8 in this illustrated embodiment.

We claim:

1. A forging press for rotationally asymmetrical parts by warm or hot forming, the press comprising:

a stationary press table;

a vertically shiftable press ram above the press table, vertically delimiting with the press table a working space, and vertically displaceable from an upper open position into a lower closed position;

an upper part on the ram in the space;

an upper die in the space and carried on the upper part;

a lower part on the table, in the space, and below the upper part;

a lower die on the lower part, in the space, and capable of fitting with the upper die in the closed position;

a first closing apparatus not in the space, forming a first pressurizable compartment, and bearing vertically on one of the dies;

a second closing apparatus not in the space, forming a second pressurizable compartment, and bearing vertically via the first closing apparatus on the one die; and respective first and second supplies of a compressible medium under pressure connected to the first and second compartments of the first and second apparatuses.

2. The forging press defined in claim 1, wherein the working space is has a horizontal dimension smaller than a horizontal dimension of the ram or of the table.

3. The forging press defined in claim 1, wherein the first and the second closing apparatuses are an integral part of the press and are configured so that they can be switched on and off.

4. The forging press defined in claim 1, wherein the first and second closing apparatuses are below the lower part and are effective upward through the table on the lower die.

5. The forging press defined in claim 4, further comprising:

a press rod extending vertically between the first closing apparatus and the lower die.

6. The forging press defined in claim 5, wherein the press rod is formed by parts that vertically abut each other in the upper position at an upper face of the table, whereby in the upper position the lower part and lower die can be moved horizontally out of the working space.

7. The forging press defined in claim 1, wherein the first closing apparatus can displace the one die through a longer stroke than the second closing apparatus can displace the one die.

* * * * *